US006147348A

United States Patent [19]

Quarmby et al.

[11] Patent Number: 6,147,348

[45] Date of Patent: Nov. 14, 2000

[54] METHOD FOR PERFORMING A SCAN FUNCTION ON QUADRUPOLE ION TRAP MASS SPECTROMETERS

[75] Inventors: Scott T. Quarmby, Austin, Tex.; Richard A. Yost, Gainesville, Fla.

[73] Assignee: University of Florida, Gainesville, Fla.

[21] Appl. No.: 09/313,031

[22] Filed: May 17, 1999

Related U.S. Application Data

[63] Continuation of application No. 08/837,030, Apr. 11, 1997, abandoned.

[51] Int. Cl.[7] ..... H01J 49/42

[52] U.S. Cl. ..... 250/292; 250/282

[58] Field of Search ..... 250/282, 292, 250/281, 290

[56] References Cited

U.S. PATENT DOCUMENTS

| | | | |
|---|---|---|---|
| 4,540,884 | 9/1985 | Stafford et al. . | |
| 4,736,101 | 4/1988 | Syka et al. . | |
| 5,075,547 | 12/1991 | Johnson et al. . | |
| 5,107,109 | 4/1992 | Stafford et al. . | |
| 5,171,991 | 12/1992 | Johnson et al. . | |
| 5,198,665 | 3/1993 | Wells | 250/282 |
| 5,396,064 | 3/1995 | Wells | 250/282 |
| 5,448,061 | 9/1995 | Wells | 250/282 |
| 5,479,012 | 12/1995 | Wells | 250/282 |
| 5,572,022 | 11/1996 | Schwartz et al. . | |

OTHER PUBLICATIONS

Todd, J. F. T. et al. (1990) "The use of Dynamically Programmed Scans to Generate Parent–ion Tandem Mass Spectra with the Ion–Trap Mass Spectrometer" In: Rapid Communications in Mass Spectrometry, 4(4):108–113.

Johnson, J. V. and Richard A. Yost (1990) "Tandem–in–Space and Tandem–in–Time Mass Spectrometry: Triple quadrupoles and Quadrupole Ion Traps" Anal. Chem. 62:2162–2172.

Yost, Richard A., William McClennen, and A. Peter Snyder (1987) "Picogram To Microgram Analysis By Gas Chromatography/Ion Trap Mass Spectrometry" pp. 789–790, Presented at the 35th ASMS Conference on Mass Spectrometry and Allied topics, May 24–29, 1987, Denver, CO.

Stafford et al. (1987) "Enhanced Sensitivity & Dynamic Range On An Ion Trap Mass Spectrometer With Automatic Gain Control (AGC)" pp. 775–776. Presented at the 35th ASMS Conference on Mass Spectrometry And Allied topics, May 24–29, 1987, Denver, CO.

Lammert, Stephen A. (1987) Data–Dependent Instrument Control on the Finnigan MAT TSQ® 70, Techical Report, Finnigan MAT No. 603, Copyright 1987, pp. 1–10.

Dependent Data Settings Dialog Box—Scan Event Tab [EME] from Finnigan MAT LCQ Online Help.

*Primary Examiner*—Kiet T. Nguyen

*Attorney, Agent, or Firm*—Saliwanchik, Lloyd & Saliwanchik

[57] ABSTRACT

The subject invention pertains to a scan function which will allow parent and neutral loss scans, with a reduced number of false positives, greater detection efficiency, shortened time periods, and enhanced mass resolution, to be performed on the quadrupole ion trap mass spectrometer. In a specific embodiment, the subject invention involves first trapping ions of interest and obtaining a mass spectrum of the m/z range of interest. The (m/z)'s which are present and meet certain predetermined criteria can then be selected and stored. Ions are again trapped in the ion trap and then all ions with (m/z)'s below that of the first ion of interest are ejected. The first ion of interest is resonantly excited to cause CID and the presence of a particular daughter ion is then determined using a standard mass-selective instability scan over a narrow m/z range with resonant ejection at a predetermined ejection $q_z$. The ion trap is then cleared of all ions with (m/z)'s below that of the next ion of interest and the process is repeated.

25 Claims, 11 Drawing Sheets

METHOD FOR PERFORMING A SCAN FUNCTION ON QUADRUPOLE ION TRAP MASS SPECTROMETERS

CROSS-REFERENCE TO A RELATED-APPLICATION

This is a continuation of application Ser. No. 08/837,030 filed Apr. 11, 1997, now abandoned.

BACKGROUND OF THE INVENTION

The quadrupole ion trap invented by Paul and Steinwedel (Paul, W. and H. Steinwedel (1960) U.S. Pat. No. 2,939,952) is a highly versatile and sensitive mass spectrometer. An important analytical use of quadrupole ion trap mass spectrometers is tandem mass spectrometry (MS/MS).

The fundamentals and operation of MS/MS on the quadrupole ion trap mass spectrometer have been previously described (March, R. E. et al. Eds. (1989) *Quadrupole Storage Mass Spectrometry* (John Wiley & Sons, New York); March, R. E., et al. Eds. (1995) *Practical Aspects of Ion Trap Mass Spectrometry* v.I–III (CRC Press, New York); and Johnson, J. V. et al. (1990 ) *Anal. Chem.* 62:2162). During MS/MS, daughter ions (also called product ions) are produced by first isolating the parent ion (also called the precursor ion) and then causing the parent ion to undergo collision-induced dissociation (CID). In the ion trap, CID is produced by applying a resonant excitation waveform, for example, across the endcap electrodes. Parent ions which have a secular frequency of oscillation corresponding to the frequency of the applied resonant excitation waveform gain kinetic energy and, therefore, the amplitudes of their orbits increase. Specifically, since an ion's secular frequency is a function of that ion's mass-to-charge ratio (m/z), ions of only a small range of m/z will gain kinetic energy for a given excitation frequency. Thereafter, CID occurs as these resonantly excited ions undergo fragmentation upon colliding with a buffer gas, for example, helium which is present in the ion trap.

Current versions of commercially available quadrupole ion trap mass spectrometers which are capable of tandem mass spectrometry (MS/MS) are limited to resonantly exciting and dissociating ions of a single m/z or ions within a small m/z range. This limits the ion trap to performing only daughter ion MS/MS experiments. Specifically, the current versions of the Finnigan MAT GCQ™ and LCQ™ quadrupole ion trap mass spectrometer are able to isolate a single m/z ion (the parent ion) and fragment it to produce daughter ions which can be resonantly ejected from the ion trap, using a mass-selective instability scan, and subsequently detected. However, there are two other very useful types of MS/MS scan modes, namely, parent and neutral loss scans, also called precursor scans and constant neutral loss scans. Both of these scan modes are useful for screening samples for the presence of particular analytes. In particular, parent scans are useful for screening for classes of compounds whose parent ions fragment to a common and characteristic daughter ion, and neutral loss scans are useful for screening for classes of compounds whose parent ions fragment upon CID to form daughter ions via loss of a common neutral fragment.

A technique was previously described for performing parent and neutral loss experiments on the quadrupole ion trap (Johnson, J. V. et al. (1991) U.S. Pat. No. 5,075,547). The Johnson et al. (1991) disclosure employed a sequential pulsing of resonant excitation waveforms of appropriate frequency and voltage to sequentially fragment several parent ion (m/z)'s and determine if each produced the particular daughter ion m/z of interest. There are several limitations to using the Johnson et al. (1991) technique for practical screening of analytical samples. First, because the RF voltage applied to the ring electrode was held constant while each of the different parent (m/z)'s were fragmented, CID was performed at a different $q_z$ for each parent m/z ($q_z$ RF Voltage/(m/z)). Since the efficiency of CID is known to vary with $q_z$, this results in different analysis sensitivities for the different (m/z)'s of the parent ions. Second, daughter ions of different (m/z)'s were detected using resonant ejection with the RF voltage constant. Since daughter (m/z)'s are resonantly ejected at different $q_z$'s, both mass resolution and detection efficiency are dependent on the m/z of the daughter ion. In addition, standard mass calibration which is used for conventional mass analysis cannot be used, requiring an extra calibration procedure. Finally, no method of determining which parent ion (m/z)'s will be fragmented is given, meaning the operator must know which parent ion (m/z)'s are being interrogated. However, the parent (m/z)'s which will be present in a sample is usually not known a priori.

Another technique was previously described for performing parent and neutral loss experiments on the quadrupole ion trap (Johnson, J. V. et al. (1992) U.S. Pat. No. 5,171,991). The Johnson et al. (1992) disclosure employed the simultaneous application of two resonant excitation voltages or waveforms across the endcap electrodes. First, a daughter ion resonant excitation waveform, corresponding to the secular frequency of the characteristic daughter ions, is applied to cause rapid resonant excitation and ejection of any characteristic daughter ions through an opening in an exit endcap, whereby the characteristic daughter ions can then be detected. After any characteristic daughter ions in the trap have been ejected and while still applying the characteristic daughter ion resonant excitation waveform, a parent ion resonant excitation waveform, corresponding to the secular frequency of the parent ion of interest, is applied, at an appropriate voltage to induce CID of the parent ions with minimal ejection of the parent ions from the trap. A positive result for a given m/z parent ion occurs when CID of that parent ion produces the characteristic daughter ion which is ejected and detected. However, even though the Johnson et al. (1992) disclosure allows for a fast scan over all relevant parent ion m/z, when the parent ions undergo CID there can be some parent ions which are resonantly ejected. These ions can be detected and produce false positive readings for the detection of the characteristic daughter ions. Also, when the parent ions undergo CID three can be some daughter ions produced which are too low in m/z to be stable within the ion trap and are therefore ejected. This can result in false positive readings for the detection of the characteristic daughter ions. Any of these or other false positive readings are unacceptable for most applications.

BRIEF SUMMARY OF THE INVENTION

The subject invention pertains to a scan function which will allow parent and neutral loss scans, with a reduced number of false positives, greater detection efficiency, shortened time periods, and enhanced mass resolution, to be performed on the quadrupole ion trap mass spectrometer. These performance characteristics allow parent and neutral loss scans to be performed on unknown samples, i.e., samples where the parent ions of interest are not, a priori, known, and smaller samples, due to the shorter time periods required for the scans.

Specifically, the subject invention comprises a method for performing parent and neutral loss scans on the quadrupole ion trap according to the flow chart shown in FIG. 1. First, ions are trapped in the ion trap and a mass spectrum obtained of the m/z range of interest for the parent scan. From this initial mass spectrum, or prescan, the (m/z)'s which are present and/or meet at least one predetermined criterion are selected and stored. These stored (m/z)'s will later be interrogated using CID to determine if they produce the particular daughter ion being screened for. Because of chromatographic time constraints and issues of ion storage efficiency over long periods of time, it is not currently practical to interrogate ions of every m/z, over a wide m/z range. Advantageously, the subject prescan allows the instrument to interrogate only those (m/z)'s in the sample which are present and/or meet at least one predetermined criterion, thereby greatly speeding up the scan. In a preferred embodiment, the scan is computer controlled, thereby speeding up the scan. For this purpose, computer may comprise a microprocessor, electronic processor, or any other equivalent electronic control device.

Once the (m/z)'s which will be fragmented are chosen, ions are again trapped in the ion trap. All ions with (m/z)'s below that of the first parent m/z are ejected from the ion trap. The RF voltage is adjusted such that the first parent m/z, for example of lowest m/z, is at a predetermined CID $q_z$ and resonantly excited to cause CID. Assuming all resulting daughter ions fall to (m/z)'s lower than the first parent m/z (not necessarily the case for multiply charged ions), the presence of a particular daughter ion is then determined using a standard mass-selective instability scan over a narrow m/z range with resonant ejection at a predetermined ejection $q_z$. The ion trap is then cleared of all (m/z)'s below that of the next parent ion, to prevent false positive detection of a daughter ion, and the process repeated. Note that with this method, all resonant excitations can be performed at the same $q_z$, namely the predetermined CID $q_z$, for all parent (m/z)'s, and all resonant ejections can be performed at the same $q_z$, namely the predetermined ejection $q_z$, for all daughter (m/z)'s. This assures efficient CID for all parent (m/z)'s and the ability to use a standard m/z calibration with this scan. In addition, many parent (m/z)'s may be fragmented, sequentially, after the ion trap is initially filled thereby preventing the need for a time consuming ion trap filling step before each parent m/z.

DETAILED DISCLOSURE OF THE INVENTION

The subject invention pertains to a scan function which will allow parent and neutral loss scans, with a reduced number of false positives, greater detection efficiency, shortened time periods and enhanced mass resolution, to be performed on the quadrupole ion trap mass spectrometer. These performance characteristics allow parent and neutral loss scans to be performed on unknown samples, i.e., samples where the parent ions of interest are not, a priori, known, and smaller samples, due to the shorter time periods required for the scans.

Figure 1:
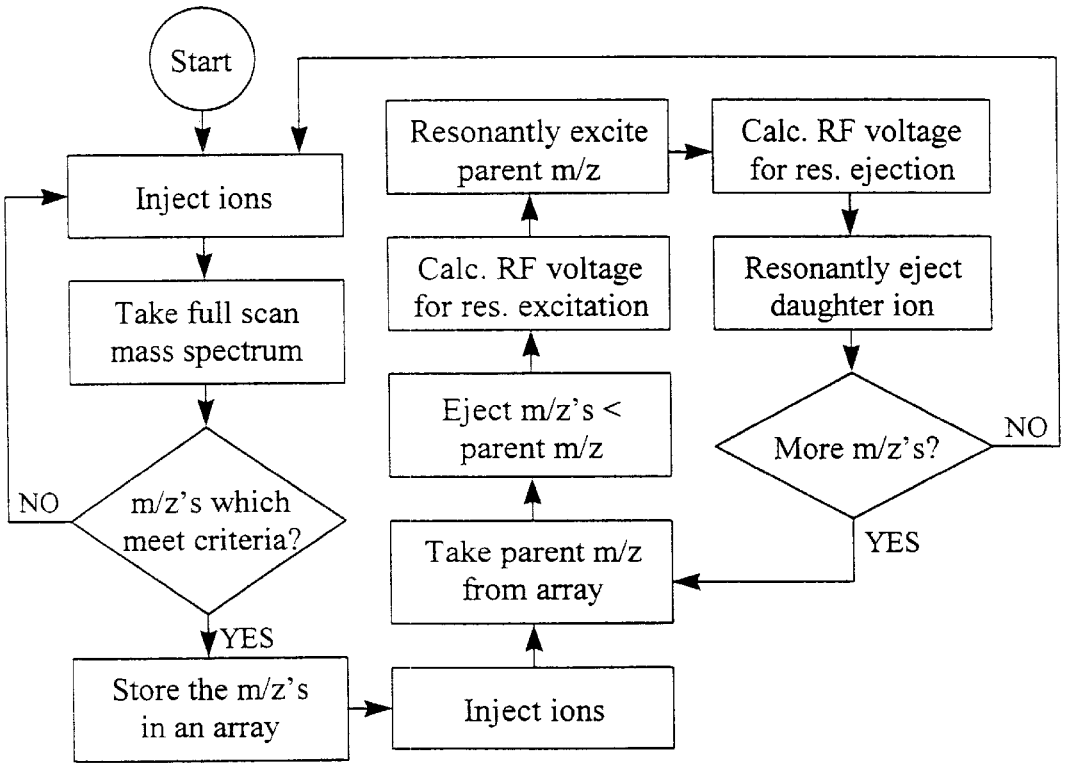
FIG. 1 shows a flow chart of a parent or neutral loss scan.
Figures 2A, 2B:
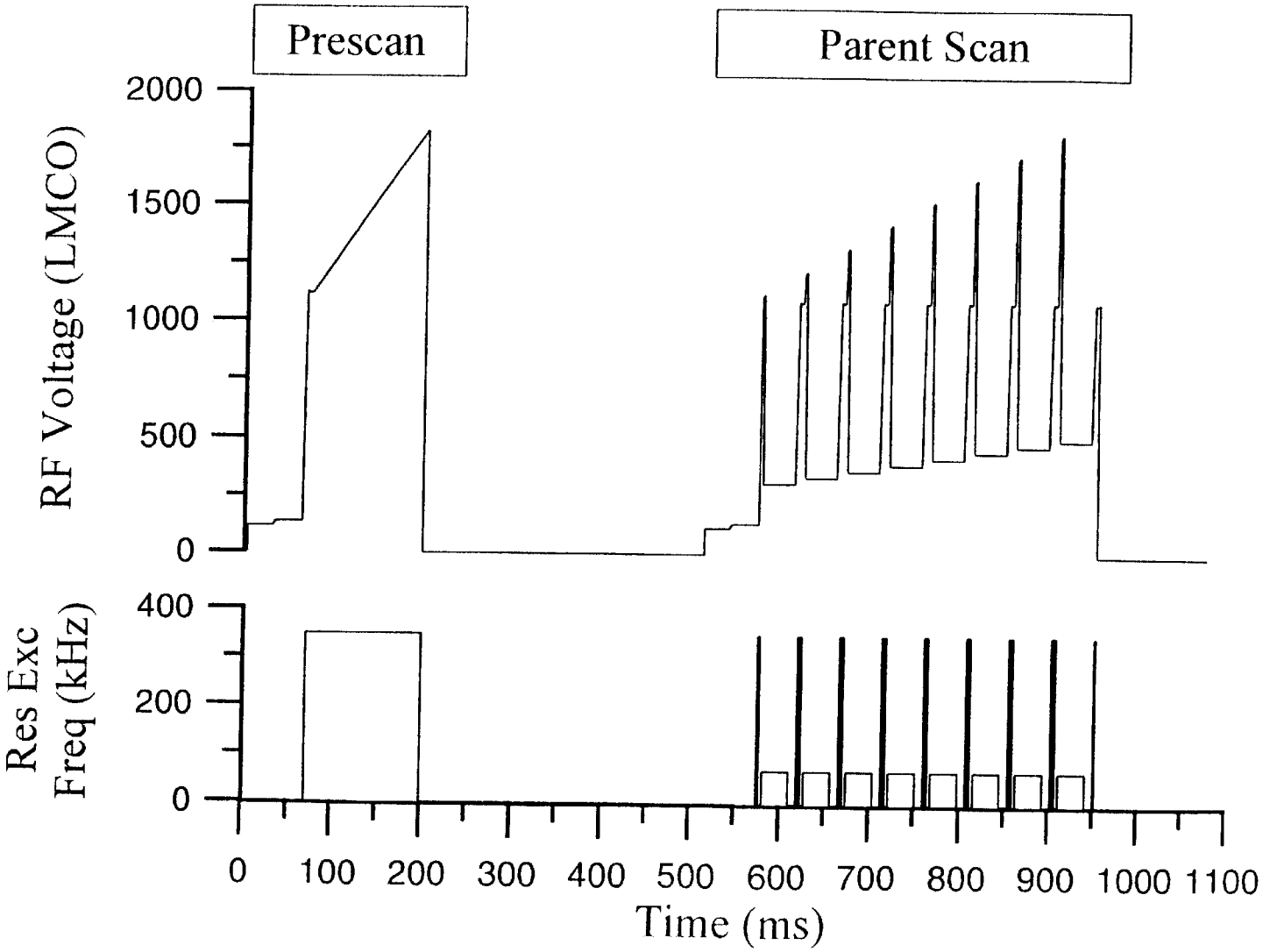
FIGS. 2(A–E) show a scan function including a prescan for obtaining a parent scan.
Figures 2C, 2D, 2E:
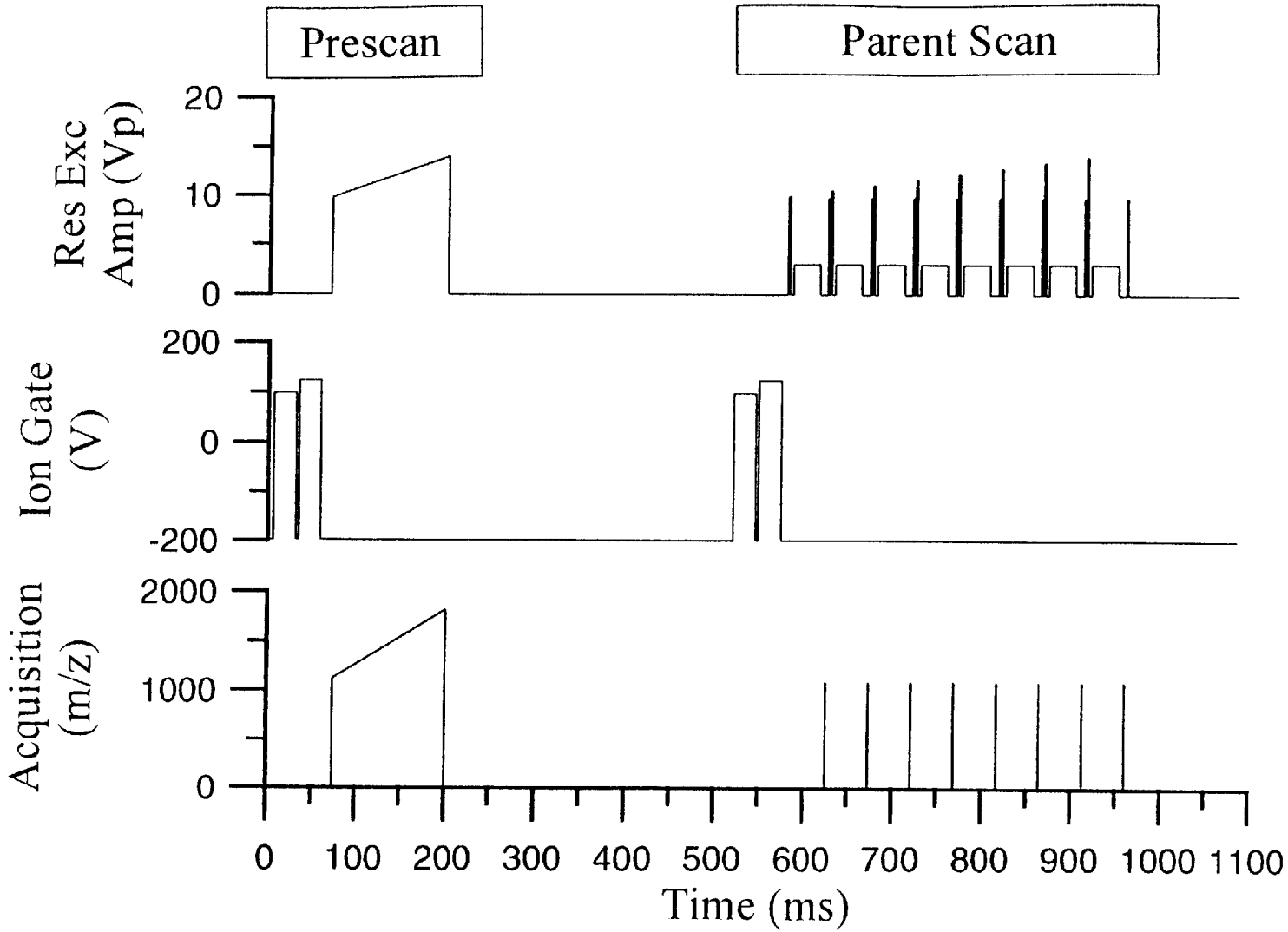
Figures 3A, 3B:
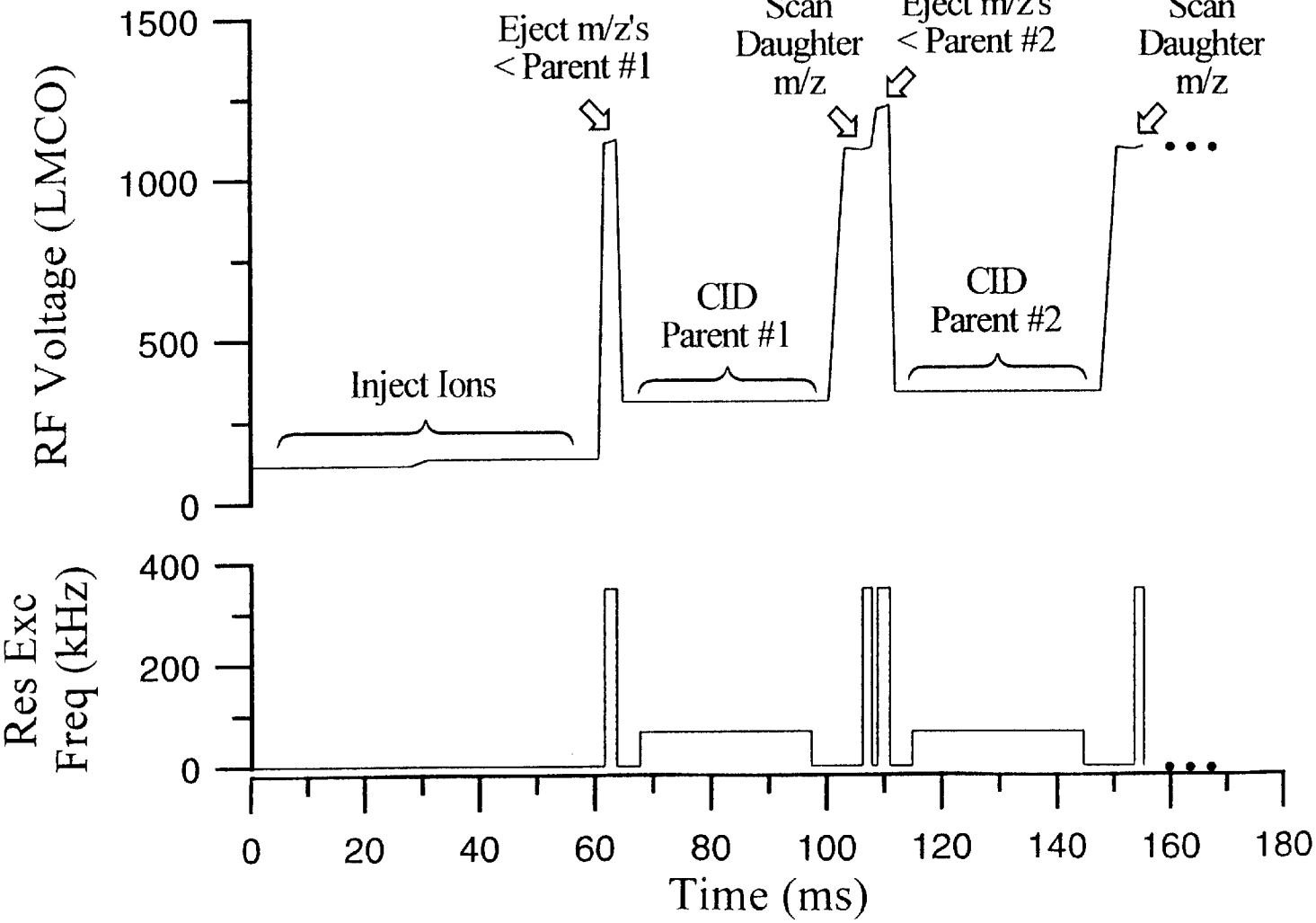
FIGS. 3(A–E) show a parent scan for the first two parent ion (m/z)'s in more detail.
Figures 3C, 3D, 3E:
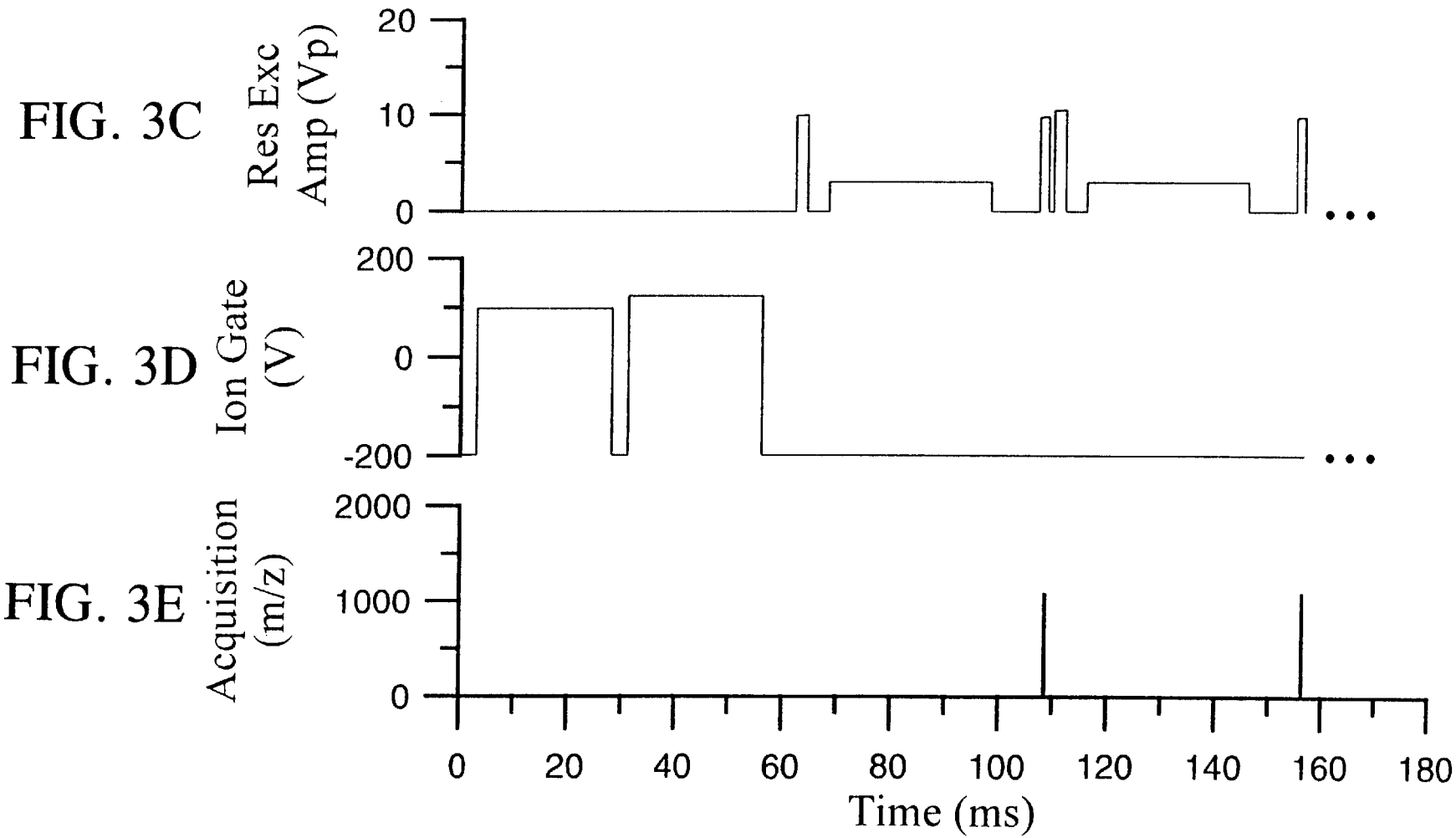

Specifically, the subject invention comprises a method for performing parent and neutral loss scans on the quadrupole ion trap according to the flow chart shown in FIG. 1. First, ions are trapped in the ion trap by, for example, forming ions directly in the ion trap or injecting externally formed ions, and a mass spectrum obtained of the m/z range of interest for the parent scan. From this initial mass spectrum, or prescan, the (m/z)'s which are present and/or meet at least one predetermined criterion are selected and stored. For example, one particular criterion for selection could be the (m/z)'s with the largest intensity in the prescan. These stored (m/z)'s will later be interrogated using CID to determine if they produce the particular daughter ion being screened for. Because of chromatographic time constraints and issues of ion storage efficiency over long periods of time, it is not currently practical to interrogate ions of every m/z, over a wide m/z range. Advantageously, the prescan allows the instrument to interrogate only those (m/z)'s which are present in the sample and/or meet at least one criterion thereby greatly speeding up the scan. In a preferred embodiment, the scan is computer controlled, thereby speeding up the scan. For this purpose, computer may comprise a microprocessor, electronic processor, or any other similar control device.

Once the (m/z)'s which will be fragmented are chosen, ions are trapped in the ion trap. All ions with (m/z)'s below that of the first parent m/z are ejected from the ion trap. The RF voltage is adjusted such that a first parent m/z, for example of lowest m/z, is at a predetermined CID $q_z$, for example a $q_z$ of 0.25, and resonantly excited to cause CID. Assuming all resulting daughter ions fall to (m/z)'s lower than the parent m/z (not necessarily the case for multiply charged ions), the presence of a particular daughter ion is then determined using a standard mass-selective instability scan with resonant ejection at a predetermined ejection $q_z$, for example a $q_z$ of 0.9. The ion trap is then cleared of all (m/z)'s below that of the next parent ion (to prevent false positive detection of a daughter ion) and the process repeated. Note that with this method, all resonant excitations can be performed at the same $q_z$, namely the predetermined CID $q_z$, for all parent (m/z)'s, and all resonant ejections can be performed at the same $q_z$, namely the predetermined ejection $q_z$, for all daughter (m/z)'s. This assures efficient CID for all parent (m/z)'s and the ability to use a standard m/z calibration with this scan. In addition, many parent (m/z)'s may be fragmented, sequentially, after the ion trap is initially filled thereby preventing the need for a time consuming ion trap filling step before each parent m/z.

For a specific embodiment, a scan function of a parent scan is shown in FIGS. 2A–2E. Here the two main segments of the scan, both the prescan and the parent scan are shown. The parent scan shows parent (m/z')s 1122, 1222, 1322, 1422, 1522, 1622, 1722, and 1822 being sequentially fragmented and, for each fragmented parent, any daughter ion produced at m/z 1090 detected. The prescan generates a conventional full scan mass spectrum which the computer uses to choose and store the appropriate parent (m/z)'s. These parent (m/z)'s are then sequentially fragmented and the resulting daughter (m/z)'s scanned. FIGS. 3A–3E show the parent scan for the first two parent (m/z)'s in more detail. Here only the parent scan is shown for the first two parent (m/z)'s, 1122 and 1222. Again, any daughter at m/z 1090 is detected. These scans can be, for example, programmed on a Finnigan MAT LCQ™ quadrupole ion trap mass spectrometer.

The scan of the subject invention is applicable to both parent and neutral loss scans; the only difference is in the daughter m/z which is scanned following CID. Specifically, for a parent scan the daughter m/z is constant while for a neutral loss scan the daughter m/z is always a specific m/z below the parent m/z.

The method of the subject invention can comprise real time computer calculations to vary the RF voltage so resonant excitation for CID of parent (m/z)'s can be performed at a constant CID $q_z$, and resonant ejection of daughter (m/z)'s for detection can be performed at a constant ejection $q_z$'s. In addition, a prescan can be used which identifies and stores which parent (m/z)'s are present in the sample and meet certain criteria, and uses those as parent (m/z)'s for the subsequent parent or neutral loss scan and corresponding calculations. In order to perform CID of parent (m/z)'s with different m/z ratios at a constant $q_z$, for example a $q_z$ of 0.25, and to perform resonant ejection of daughter ions at a constant $q_z$, for example a $q_z$ of 0.9, the real time computer calculations of the subject invention must calculate the appropriate RF trapping voltage magnitude, V, according to the equation:

$$V = \frac{m}{z}\frac{q_z(r_o^2 + 2z_0^2)\Omega^2}{8e}$$

where $r_o$ is the radius of the ring electrode $z_o$ is the minimum distance from the center of the trap to the endcap electrodes $\Omega$ is the angular frequency of the RF trapping voltage e is the charge of an electron Therefore, the ions having a higher m/z ratio require a higher magnitude RF voltage to be maintained at the predetermined $q_z$.

Figure 4A:
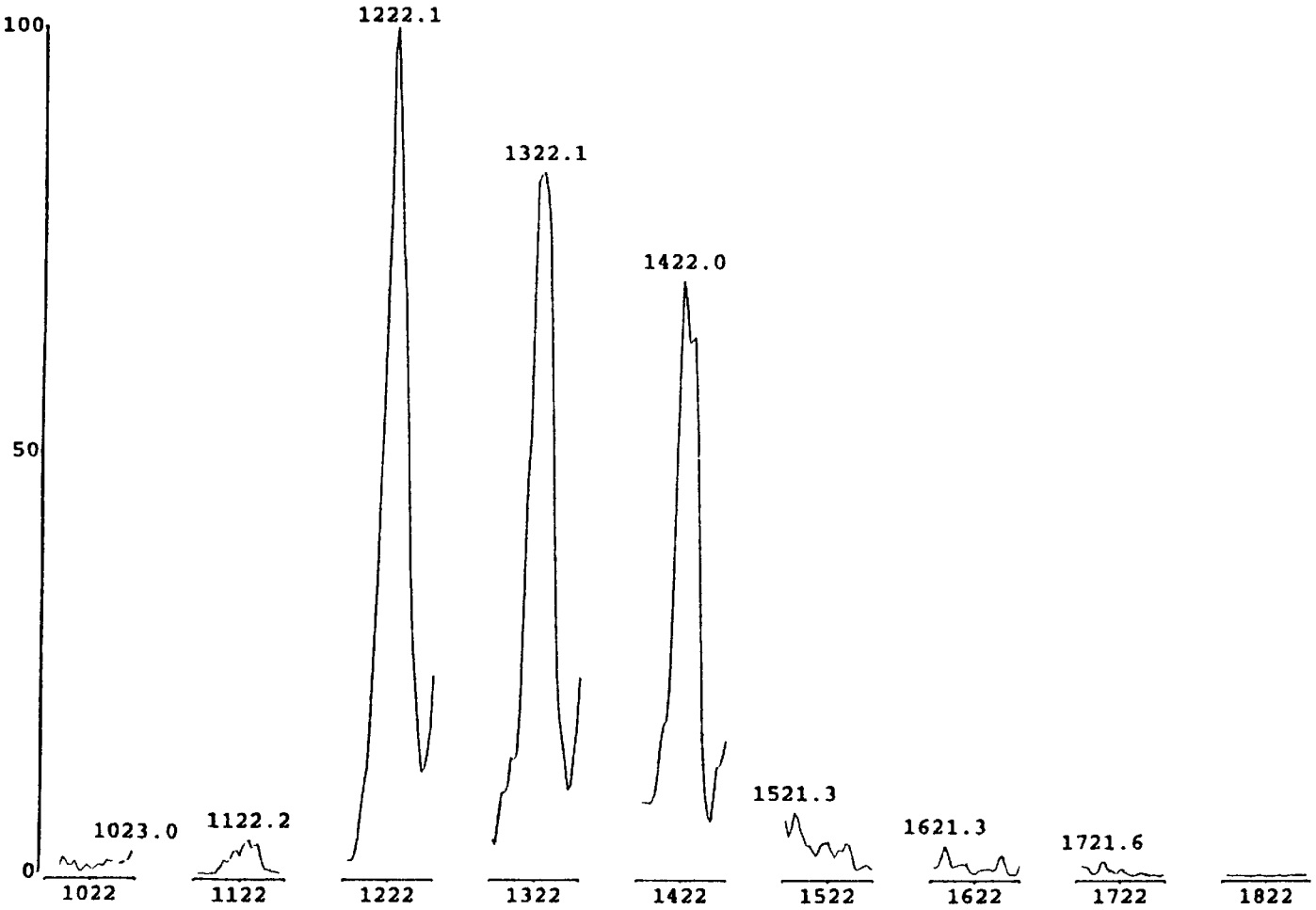
FIG. 4A shows a parent scan of Ultramark 1621 using no prescan, for parents of m/z 1090.
Figure 4B:
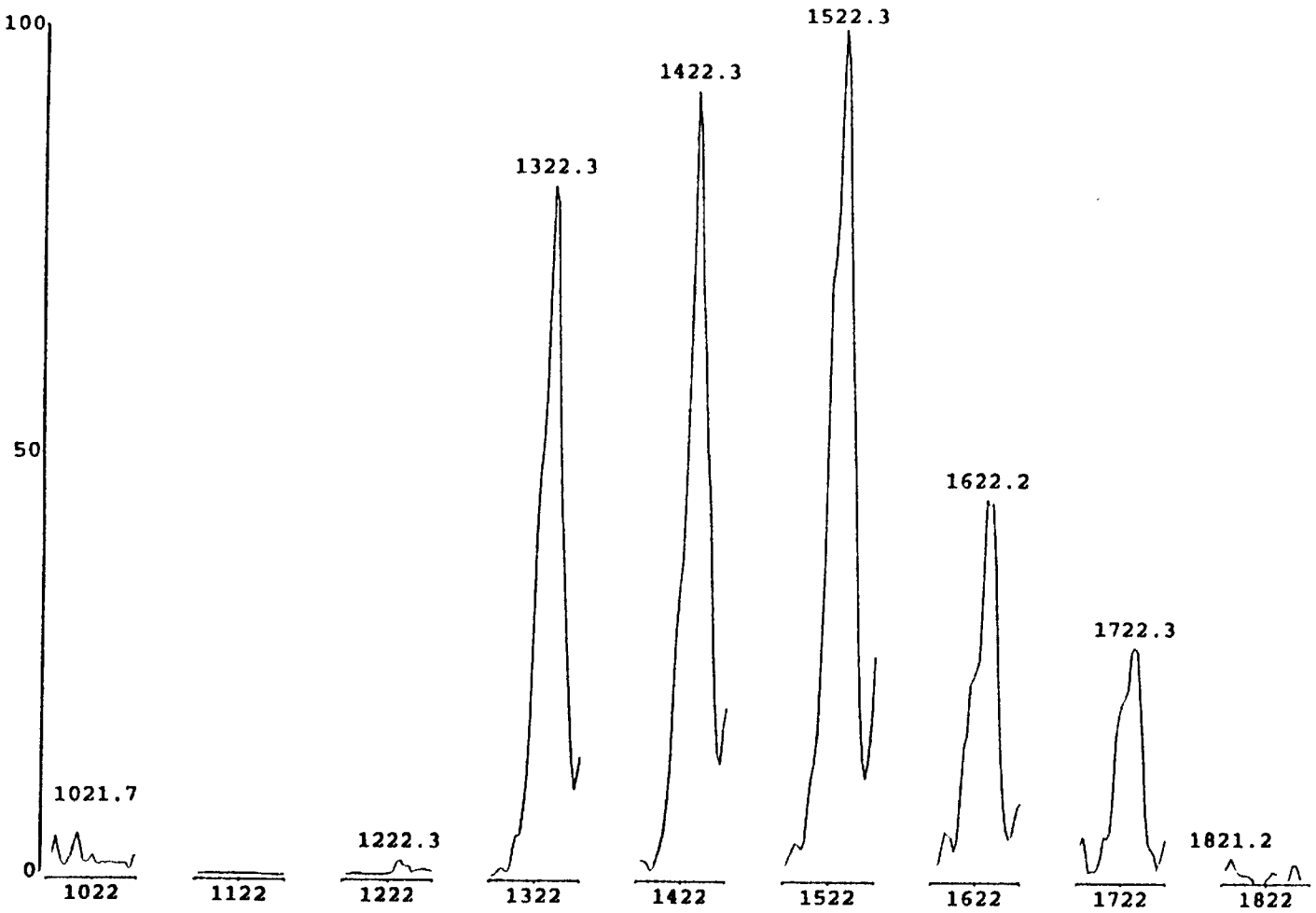
FIG. 4B shows a parent scan of Ultramark 1621 using no prescan, for parents o m/z 1078.
Figure 5A:
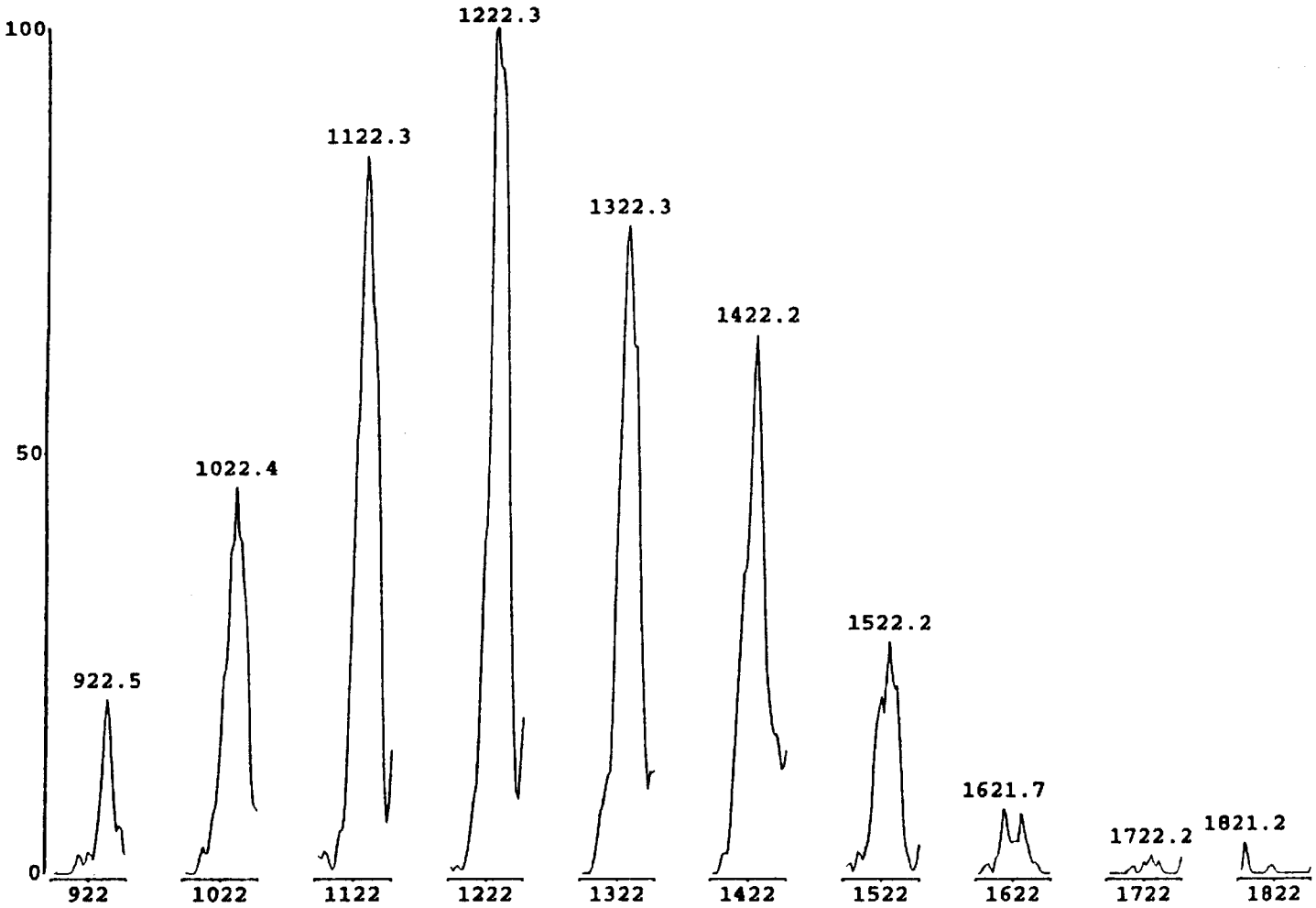
FIG. 5A shows a neutral loss scan of Ultramark 1621 using no prescan, for neutral loss of m/z 32.
Figure 5B:
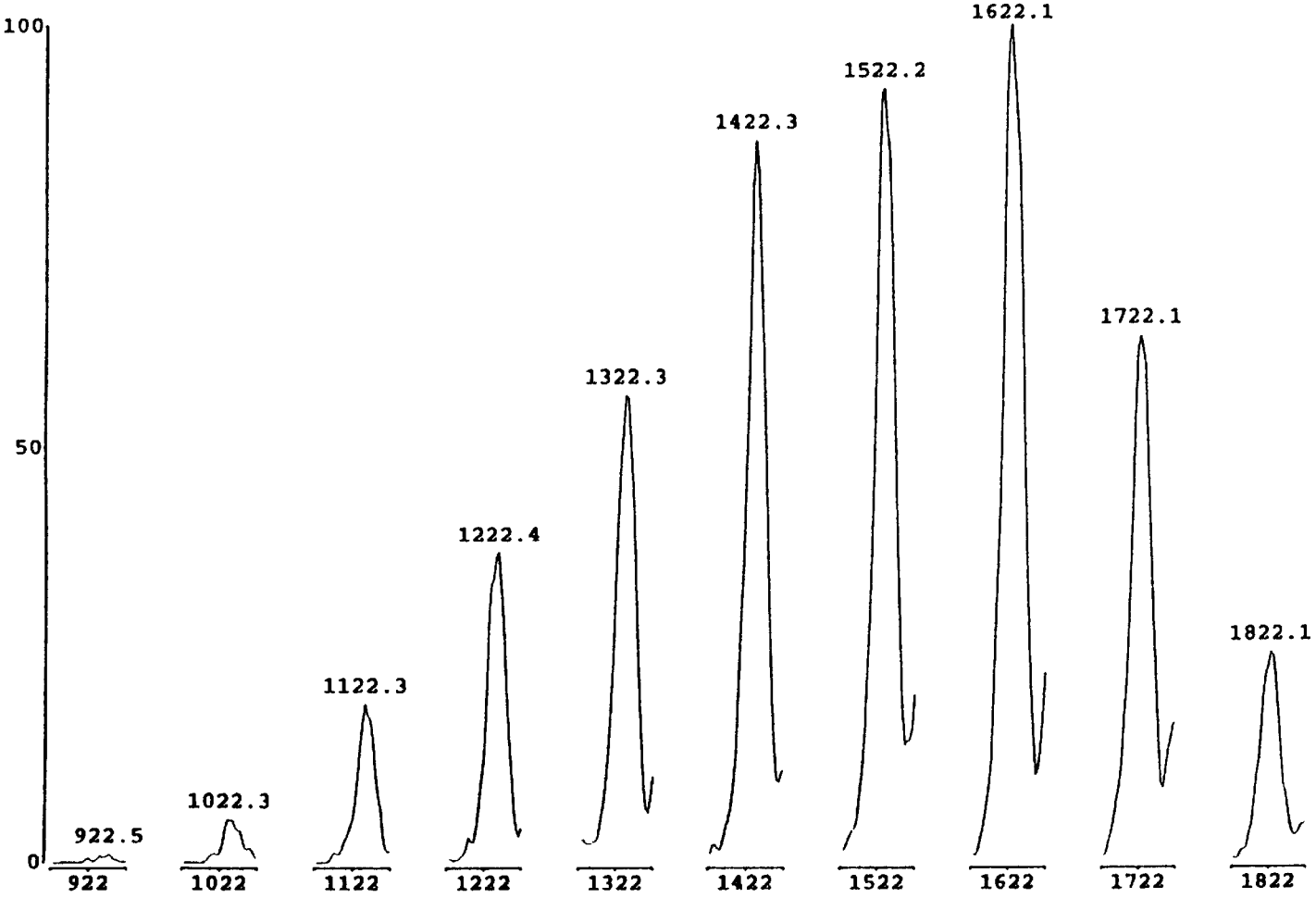
FIG. 5B shows a neutral loss scan of Ultramark 1621 using no prescan, for neutral loss of m/z 232.

Referring to FIGS. 4A, 4B, 5A, and 5B, Ultramark 1621 (PCR, Gainesville, Fla.), a mixture of fluorinated phosphazines, was infused at a flow rate of 3 $\mu$L/min. A 0.05% solution of Ultramark 1621 was prepared in 50% acetonitrile/25%methanol/25% water and acidified with 2% acetic acid. Electrospray ionization produces a series of $[M+H]^+$ ions at (m/z)'s ranging from 922 to 2222 in 100 amu intervals. In the set of experiments corresponding to FIGS. 4A, 4B, 5A, and 5B, no prescan was used; instead, the scan was programmed to always fragment a predetermined list of (m/z)'s. Two parent scans are shown in FIGS. 4A and 4B and two neutral loss scans are shown in FIGS. 5A and 5B. The parent scans of FIGS. 4A and 4B were programmed to fragment parent (m/z)'s 1022, 1122, 1222, 1322, 1422, 1522, 1622, 1722, and 1822. FIG. 4A shows the parents of m/z 1090, while FIG. 4B shows the parents of m/z 1078. The neutral loss scans of FIGS. 5A and 5B were programmed to fragment parent (m/z)'s 922, 1022, 1122, 1222, 1322, 1422, 1522, 1622, 1722, and 1822. FIG. 5A shows the parents which fragment with a neutral loss of m/z 32, while FIG. 5B shows the parents which fragment with a neutral loss of m/z 232.

Figure 6A:
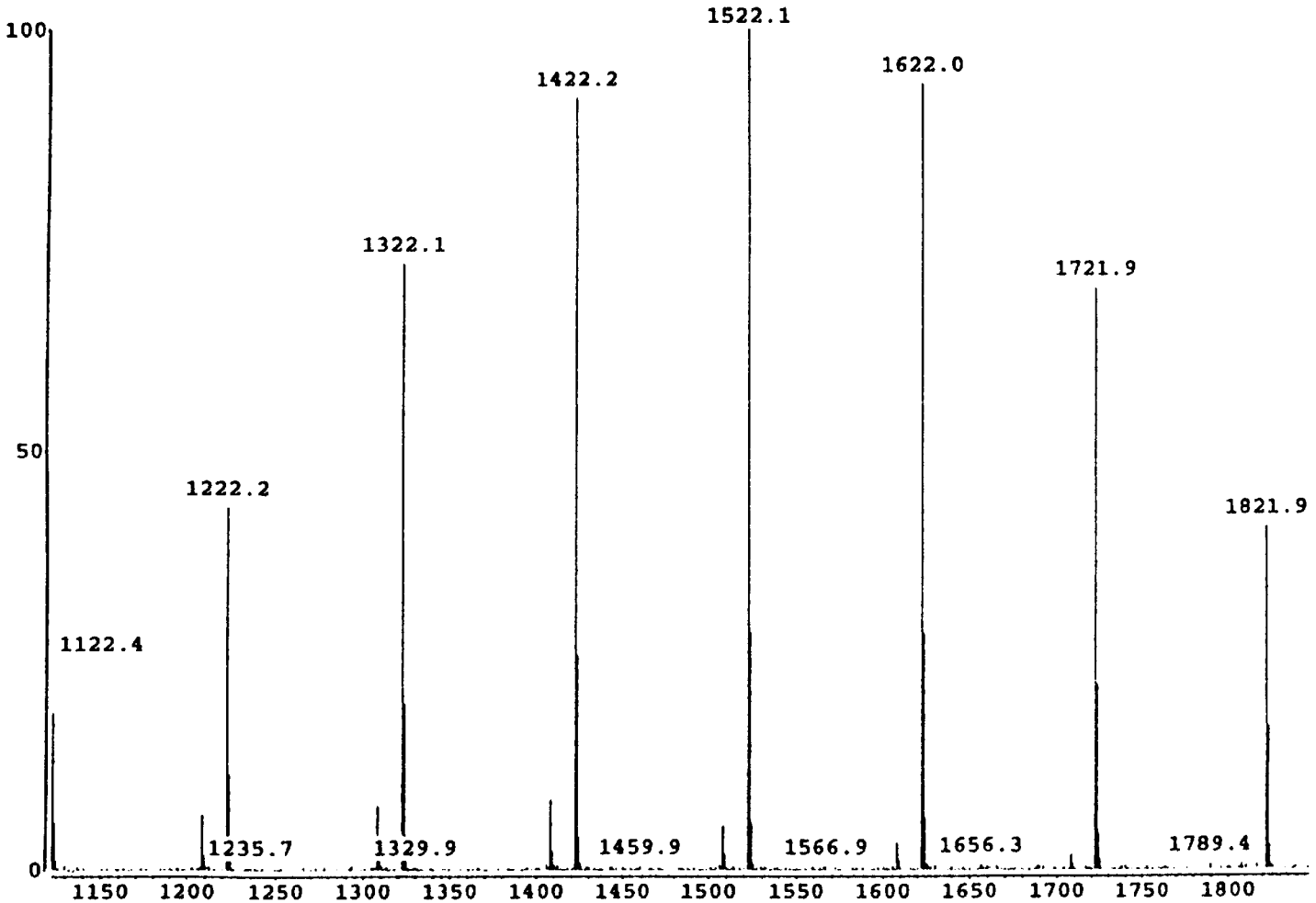
FIG. 6A shows a prescan mass spectrum of m/z 1122 to 1850 for Ultramark 1621.
Figure 6B:
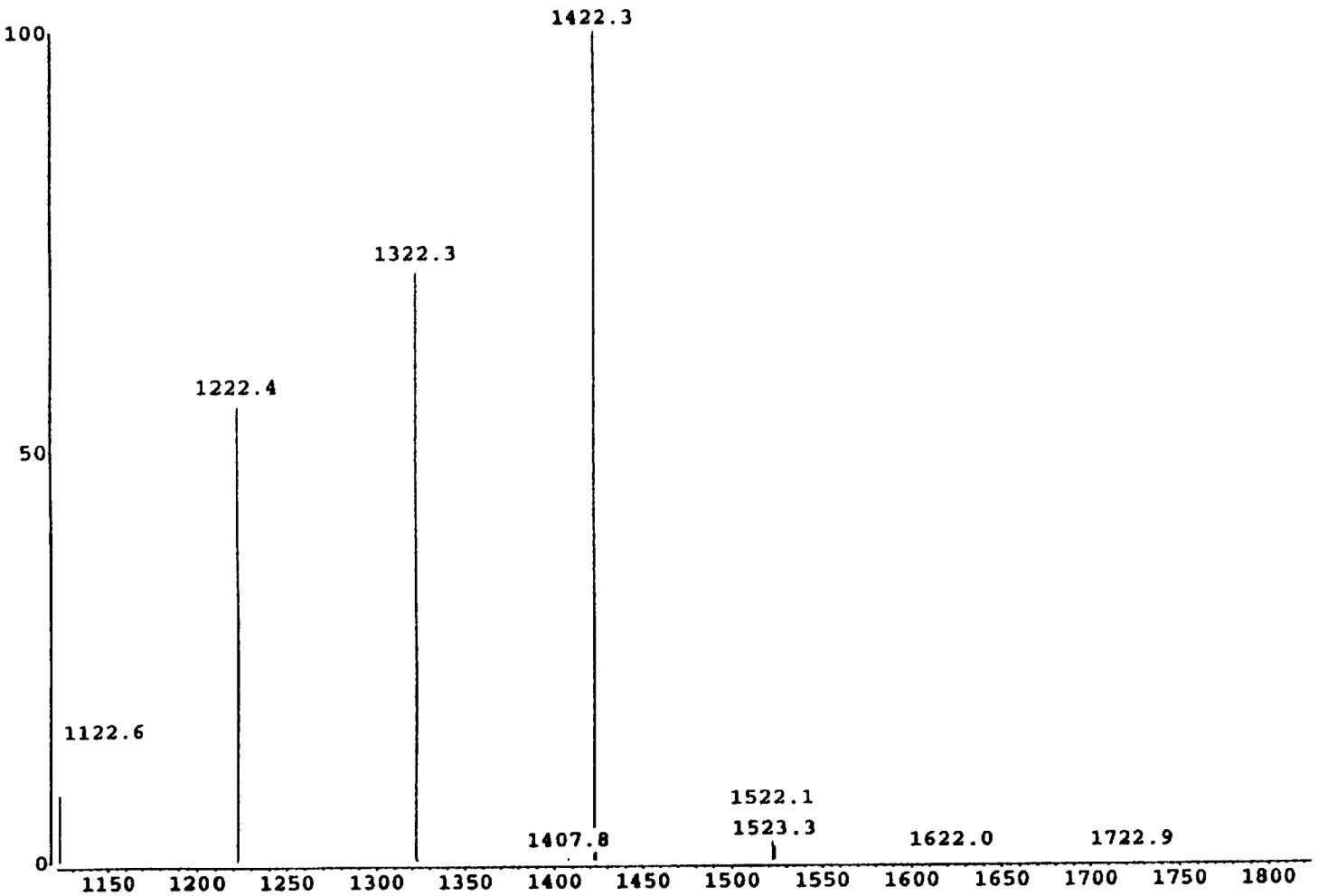
FIG. 6B shows a parent scan of Ultramark 1621 using a prescan, of m/z 1090.

Investigating the same mixture, Ultramark 1621, utilizing the subject invention, the prescan acquires a full scan mass spectrum over the m/z range which parent (m/z)'s are to be interrogated. For example, in a specific embodiment, the 18 most intense ions detected in the prescan are chosen to be fragmented as parent ions. FIG. 6A shows the mass spectrum of m/z 1122 to 1850 obtained from the prescan and FIG. 6B shows the resulting parent scan of m/z 1090. In this embodiment, the parent scan was limited to the 18 most intense (m/z)'s in the spectrum. However, these scans are clearly not limited to choosing only the 18 most intense ions. Several methods of choosing the (m/z)'s to interrogate include: the most intense, the most intense that do not include (m/z)'s on an exclusion list, the most intense (m/z)'s listed on an inclusion list, or almost any other criteria. The utilization of the prescan to determine the (m/z)'s to fragment allows the analysis of unknown samples. Unknown samples are common in analyses where parent and neutral loss scans are utilized. Without the prescan, all (m/s)'s in the m/z range of interest would need to be interrogated by CID for production of the desired daughter ion m/z. This scan in many situations would take a prohibitively long time. Also, by performing the CID of the parent ions at a constant $q_z$ value allows efficient fragmentation of all parent ions. In addition, ejecting the resulting characteristic daughter ions under the conditions used for a standard mass spectrum allows the standard m/z calibration to be used as well as obtaining the same resolution as in a standard mass spectrum.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. A method for performing a scan function on a quadrupole ion trap, comprising the following steps:

a) trapping sample ions in the ion trap;

b) obtaining a mass spectrum of the sample ions;

c) selecting and storing the mass-to-charge ratios of the ions which are present and/or meet at least one predetermined criterion;

d) trapping additional sample ions in the trap;

e) ejecting all ions with mass-to-charge ratios below the lowest stored mass-to-charge ratio;

f) resonantly exciting ions of the lowest stored mass-to-charge ratio;

g) performing a mass-selective instability scan over a mass-to-charge ratio range of interest;

h) ejecting all ions with mass-to-charge ratios below the next lowest stored mass-to-charge ratio;

i) resonantly exciting ions of the next lowest stored mass-to-charge ratio;

j) performing a mass-selective instability scan over a mass-to-charge ratio range of interest; and k) repeating steps h, i, and j until ions of all stored mass-to-charge ratios have been resonantly excited, wherein the scan provides information about the sample ions.

2. A method for performing a scan function on a quadrupole ion trap to obtain information about a sample, comprising the following steps:

a) trapping sample ions in the ion trap;

b) obtaining a mass spectrum of the sample ions;

c) selecting the mass-to-charge ratios of the ions which meet at least one criterion;

d) ejecting all ions with mass-to-charge ratios below the lowest selected mass-to-charge ratio;

e) fragmenting ions of the lowest selected mass-to-charge ratio;

f) obtaining a mass spectrum over a mass-to-charge ratio range of interest;

g) ejecting all ions with mass-to-charge ratios below the next lowest selected mass-to-charge ratio;

h) fragmenting ions of the next lowest selected mass-to-charge ratio;

i) obtaining a mass spectrum over a mass-to-charge ratio range of interest; and j) repeating steps g, h, and i until ions of each selected mass-to-charge ratios have been fragmented.

3. The method according to claim 2, wherein after the step of selecting the mass-to-charge ratios of the ions which meet at least one criterion, further comprising the step of trapping additional sample ions in the trap.

4. The method according to claim 2, wherein the steps of obtaining a mass spectrum over a mass-to-charge ratio range of interest comprises the following steps:

calculating the RF voltage required for resonant ejection of ions having a predetermined mass-to-charge ratio; and resonantly ejecting any ions having said predetermined mass-to-charge ratio.

5. The method according to claim 4 wherein said predetermined mass-to-charge ratio corresponds to a particular daughter ion.

6. The method according to claim 2, wherein the step of obtaining a mass spectrum over a mass-to-charge ratio range of interest comprises the following steps:

calculating the RF voltage required for resonant ejection of ions having a mass-to-charge ratio which is a predetermined amount lower than the mass-to-charge ratio of the ions fragmented in the prior step; and resonantly ejecting any ions having a mass-to-charge ratio which is a predetermined amount lower than the mass-to-charge ratio of the ions fragmented in the prior step.

7. The method according to claim 6, wherein said predetermined amount lower corresponds to a particular neutral loss.

8. The method according to claim 2, wherein all resonant ejections are performed at approximately the same ejection $q_z$.

9. The method according to claim 2, wherein ions are fragmented using resonant excitation.

10. The method according to claim 9, wherein all resonant excitations are performed at approximately the same CID $q_z$.

11. The method according to claim 2, wherein the criterion in step "c" is the n most intense mass-to-charge ratios in the mass spectrum, where n is an integer.

12. The method according to claim 2, wherein said scan is programmed on a quadrupole ion trap mass spectrometer.

13. The method according to claim 12, wherein said scan is fully automated without operator intervention.

14. The method according to claim 2, wherein the step of obtaining a mass spectrum over a mass-to-charge ratio range of interest further comprises real-time calculations in order to vary the RF voltage such that resonant ejection of the ions is performed at an approximately constant ejection $q_z$.

15. The method according to claim 2, wherein the steps of fragmenting ions further comprise real-time calculations in order to vary the RF voltage such that resonant excitation is performed at an approximately constant CID $q_z$.

16. The method according to claim 2, wherein additional sample ions are not trapped in the trap between successive repetitions of steps g, h, and i.

17. The method according to claim 2, wherein ions having a mass-to-charge ratio higher than the ions fragmented in steps e and h continue to be trapped in the ion trap immediately following the performance of steps e and h, respectively.

18. The method according to claim 2, wherein the step of selecting the mass-to-charge ratios of the ions which meet at least one criterion is based, at least in part, on the mass spectrum of the sample ions obtained in step b.

19. The method according to claim 2, wherein said method allows the interrogation of an unknown sample.

20. A method for performing a scan on an ion trap, comprising the following steps:

a) trapping sample ions in the ion trap;

b) performing an initial scan of the sample ions;

c) selecting the mass-to-charge ratios of the ions which meet at least one criterion;

d) performing, for at least one selected mass-to-charge ratio, the following steps:

i) ejecting all ions with mass-to-charge ratios below said selected mass-to-charge ratio;

ii) fragmenting ions of said selected mass-to-charge ratio;

iii) obtaining a mass spectrum over a mass-to-charge ratio range of interest.

21. The method according to claim 20, wherein after the step of selecting the mass-to-charge ratios of the ions which meet at least one criterion, further comprising the step of trapping additional sample ions in the trap.

22. The method according to claim 20, wherein step "d" is performed on each selected mass-to-charge ratio, sequentially from the lowest selected mass-to-charge ratio to the highest selected mass-to-charge ratio.

23. The method according to claim 20, wherein the step of obtaining a mass spectrum over a mass-to-charge ratio range of interest, comprises the following steps:

calculating the RF voltage required for resonant ejection of ions having a predetermined mass-to-charge ratio; and resonantly ejecting any ions having said predetermined mass-to-charge ratio.

24. The method, according to claim 20, wherein the step of obtaining a mass spectrum over a mass-to-charge ratio range of interest, comprises the following steps:

calculating the RF voltage required for resonant ejection of ions having a mass-to-charge ratio which is a predetermined amount lower than the mass-to-charge ratio of the ions fragmented in the prior step; and resonantly ejecting ions having a mass-to-charge ratio which is a predetermined amount lower than the mass-to-charge ratio of the ions fragmented in the prior step.

25. The method according to claim 20, wherein all resonant ejections are performed at approximately the same ejection $q_z$ and all resonant excitation ion fragmentations are performed with approximately the same CID $q_z$.

* * * * *